US010967662B2

(12) United States Patent
Ishibe

(10) Patent No.: US 10,967,662 B2
(45) Date of Patent: Apr. 6, 2021

(54) INK-ACCOMMODATION UNIT AND INKJET PRINTER PROVIDED WITH THE SAME

(71) Applicant: BROTHER KOGYO KABUSHIKI KAISHA, Nagoya (JP)

(72) Inventor: Akinari Ishibe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/257,213

(22) Filed: Jan. 25, 2019

(65) Prior Publication Data

US 2019/0152227 A1 May 23, 2019

Related U.S. Application Data

(60) Division of application No. 15/616,037, filed on Jun. 7, 2017, now abandoned, which is a continuation of (Continued)

(30) Foreign Application Priority Data

Dec. 10, 2014 (CN) ..... 201420780033.8
Dec. 12, 2014 (CN) ..... 201420792546.0

(51) Int. Cl.
*B41J 29/13* (2006.01)
*B41J 2/175* (2006.01)

(52) U.S. Cl.
CPC ..... *B41J 29/13* (2013.01); *B41J 2/1752* (2013.01); *B41J 2/17509* (2013.01)

(58) Field of Classification Search
CPC ..... B41J 29/13; B41J 2/1752; B41J 2/17509
See application file for complete search history.

(56) References Cited

U.S. PATENT DOCUMENTS

2004/0257411 A1 12/2004 Lee
2013/0135402 A1 5/2013 Qin et al.
(Continued)

FOREIGN PATENT DOCUMENTS

CN 203567359 U 4/2014
EP 3 231 614 A1 10/2017
(Continued)

OTHER PUBLICATIONS

International Search Report issued in related application PCT/JP2015/084625, dated Feb. 16, 2016.
(Continued)

*Primary Examiner* — Justin Seo
(74) *Attorney, Agent, or Firm* — Merchant & Gould P.C.

(57) ABSTRACT

An inkjet printer further includes a printer main body, and an ink-accommodation unit including a first member and a second member. The first member is configured to accommodate ink to be supplied to the printer main body. The first member includes an injection portion for injection of ink. The second member is pivotably movably connected to the first member. The second member is pivotable relative to the first member between a closed position and an open position. When the second member is at the closed position, the injection portion is covered by the second member. When the second member is at the open position, the injection portion is exposed. Here, an axis of the pivot is parallel to a front-rear direction of the first member, and is positioned at a side of the first member, the side being closer to the printer main body.

8 Claims, 7 Drawing Sheets

Related U.S. Application Data application No. PCT/JP2015/084625, filed on Dec. 10, 2015.

(56) References Cited

U.S. PATENT DOCUMENTS

| | | | | |
|---|---|---|---|---|
| 2014/0043408 | A1 | 2/2014 | Kudo et al. | |
| 2014/0253643 | A1 | 9/2014 | Yoda et al. | |
| 2015/0306882 | A1 | 10/2015 | Kudo et al. | |
| 2016/0207321 | A1* | 7/2016 | Osakabe | B41J 2/175 |

FOREIGN PATENT DOCUMENTS

| | | | |
|---|---|---|---|
| JP | 2004-243755 | A | 9/2004 |
| JP | 2013-949 | A | 1/2013 |
| JP | 2013-176944 | A | 9/2013 |
| JP | 2014-37057 | A | 2/2014 |
| WO | 2017/086440 | A1 | 5/2017 |

OTHER PUBLICATIONS

Notification Concerning Transmittal of International Preliminary Report on Patentability (Chapter 1 of the Patent Cooperation Treaty), dated Jun. 13, 2017.

Extended European Search Report issued in related European Patent Application No. 15866576.0, dated Jul. 5, 2018.

Office Action issued in corresponding European Patent Application No. 15 866 576.0, dated Mar. 12, 2020.

Examination Report issued in corresponding Indian Patent Application No. 201717023355, dated Jan. 30, 2020.

Office Action issued in corresponding Philippine Patent Application No. 1-2017-501074, dated Jul. 27, 2020.

Office Action issued in corresponding Indonesian Patent Application No. P00201704379, dated Mar. 3, 2020.

Office Action issued in corresponding European Patent Application No. 15 866 576.0, dated Nov. 11, 2020.

Office Action issued in corresponding European Patent Application No. 15 866 576.0, dated Nov. 20, 2020.

* cited by examiner

INK-ACCOMMODATION UNIT AND INKJET PRINTER PROVIDED WITH THE SAME

CROSS REFERENCE TO RELATED APPLICATION

This is a divisional of U.S. patent application Ser. No. 15/616,037, filed Jun. 7, 2017, which is a continuation application of International Application No. PCT/JP2015/084625 filed on Dec. 10, 2015 which claims priority to Chinese Utility Model Application No. 201420780033.8 filed Dec. 10, 2014 and Chinese Utility Model Application No. 201420792546.0 filed Dec. 12, 2014. The entire contents of the earlier applications are incorporated herein by reference.

TECHNICAL FIELD

The present invention relates to an inkjet printer and an ink-accommodation unit that is used in the inkjet printer.

BACKGROUND

An inkjet printer is configured to perform printing by ejecting ink toward a recording target (such as a printing paper). For example, one example is disclosed in a publication under Utility Model Registration No of CN203567356 U.

FIG. 1 attached hereto schematically illustrates an example of such a conventional inkjet printer. As depicted in FIG. 1, an inkjet printer 10 generally includes an ink-accommodation unit 11 and a printer main body 12. For facilitating explanation, a direction in which the inkjet printer 10 in a state to be used faces a user is defined as a frontward direction. When the inkjet printer 10 is viewed from its frontward, the ink-accommodation unit 11 is fixedly attached to a right side surface of the inkjet printer 10. The ink-accommodation unit 11 includes an ink-tank holder (not shown), and an ink tank (not shown) that is accommodated in the ink-tank holder for storing ink. Here, the ink-tank holder and the ink tank will be collectively referred to as an ink-accommodating body 21. The ink-accommodation unit 11 further includes a cover 31 that is slidable in a front-rear direction relative to the ink-accommodating body 21. On the ink-accommodating body 21, an inlet 41 is formed through which ink can be injected toward inside of an ink chamber. When ink should be injected into the ink chamber, first, the cover 31 is slid rearward. Only when the inlet 41 is completely exposed thereafter, ink can be injected into the ink chamber through the inlet 41.

SUMMARY

In actual use, when the inkjet printer 10 is placed on a desk and ink needs to be injected through the inlet 41 after ink is used up, a certain space should be preserved rearward of the inkjet printer 10 on the desk to allow sliding of the cover 31. Under such circumstances, not only a space suitable for placing the inkjet printer 10 needs to be secured on the desk, but an additional space rearward of the inkjet printer 10 also needs to be secured in advance to allow the slidable cover 31 to be opened, thereby necessitating a larger space on the desk. If the rearward space is insufficient and ink cannot be injected, the user would be forced to relocate the inkjet printer 10 to a place with a sufficient space. This structure may therefore cause inconvenience to the user. In particular, in case that only a limited space is available on the desk, the user may find difficulty in performing injection of ink.

The present invention is made in order to overcome the above-described drawbacks. An object of the present invention is to provide an ink-accommodation unit that is used in an inkjet printer, and to reduce a space that the inkjet printer occupies.

In order to attain the above and other objects, the present invention provides an ink-accommodation unit provided in an inkjet printer. Here, the inkjet printer includes a printer main body, and the ink ink-accommodation unit includes a first member and a second member. The first member is configured to accommodate therein ink to be supplied to the printer main body. The first member is provided with an injection portion through which the ink is configured to be injected. The second member is pivotably movably connected to the first member. The second member is pivotable about a pivot axis relative to the first member between a closed position and an open position such that: the injection portion is covered by the second member when the second cover is at the closed position; and the injection portion is exposed when the second cover is at the open position. The pivot axis is parallel to a front-rear direction with respect to the first member and is positioned at a side of the first member, the side being closer to the printer main body.

According to another aspect, the present invention further provides an inkjet printer including a printer main body and an ink-accommodation unit. The ink ink-accommodation unit includes a first member and a second member. The first member is configured to accommodate therein ink to be supplied to the printer main body. The first member is provided with an injection portion through which the ink is configured to be injected. The second member is pivotably movably connected to the first member. The second member is pivotable about a pivot axis relative to the first member between a closed position and an open position such that: the injection portion is covered by the second member when the second cover is at the closed position; and the injection portion is exposed when the second cover is at the open position. The pivot axis is parallel to a front-rear direction with respect to the first member and is positioned at a side of the first member, the side being closer to the printer main body.

DETAILED DESCRIPTION

Hereinafter, preferred embodiments of the present invention will be described while referring to drawings. It should be noted that the terms "top", "bottom", "front", "rear", "left", "right" and similar expressions referred to in the following description will be used for an explanatory purpose, and not be limited thereto.

In the following description, a member is "exposed" denotes a state that the member is not covered by another member and can be seen by a user when the member is viewed from above thereof. In the following description, a member is "covered" denotes a state that the member is covered by another member and cannot be seen by a user when the member is viewed from above thereof. In the following description, "parallel" or "orthogonal" means substantially or generally "parallel", or "orthogonal".

Embodiment 1

FIGS. 2 through 7 conceptually depict an ink-accommodation unit according to one preferred embodiment of the present invention that can be fixedly attached to an inkjet printer.

The inkjet printer disclosed in the present invention may have each of a scanner function, a facsimile function, a copying function and a printer function; or may only have a printing function. As a printer function, a double-surface image forming function to form images on both surfaces of a recording sheet may be provided, or only a single-surface image forming function may be provided. Here, whether or not any function other than the printer function is provided is not limited.

Figure 2:
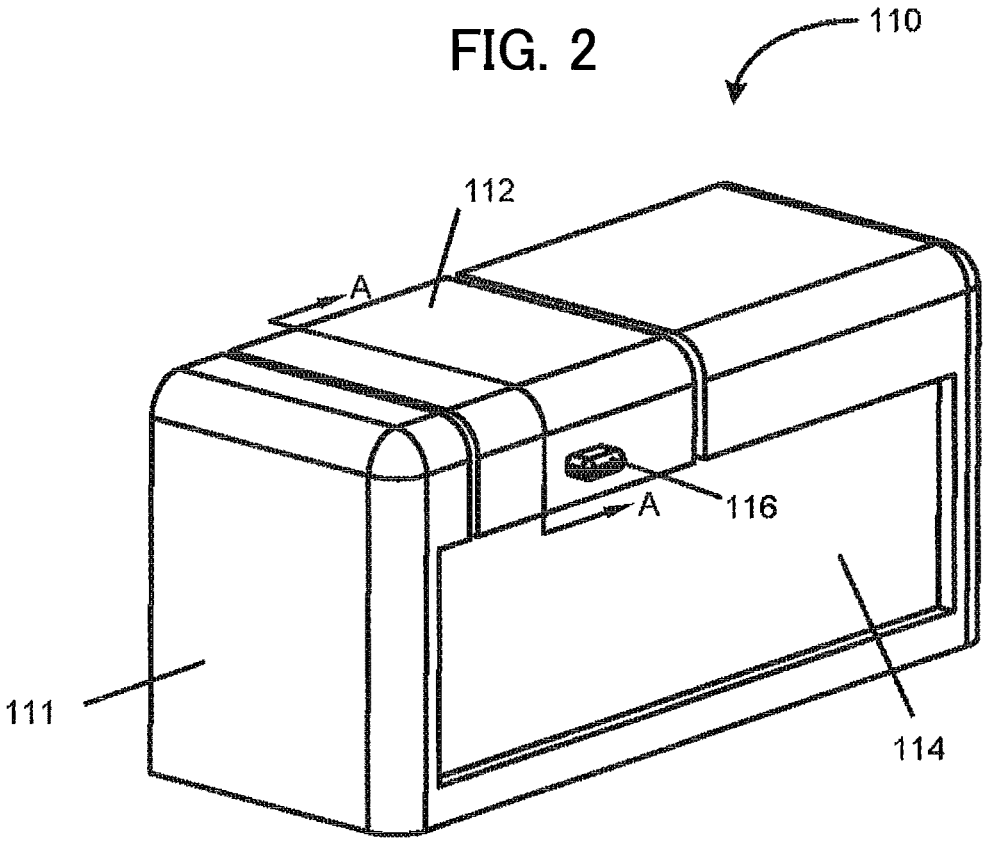
FIG. 2 is a perspective view of an ink-accommodation unit according to a preferred embodiment of the present invention, wherein a cover thereof is in a closed position.
Figure 3:
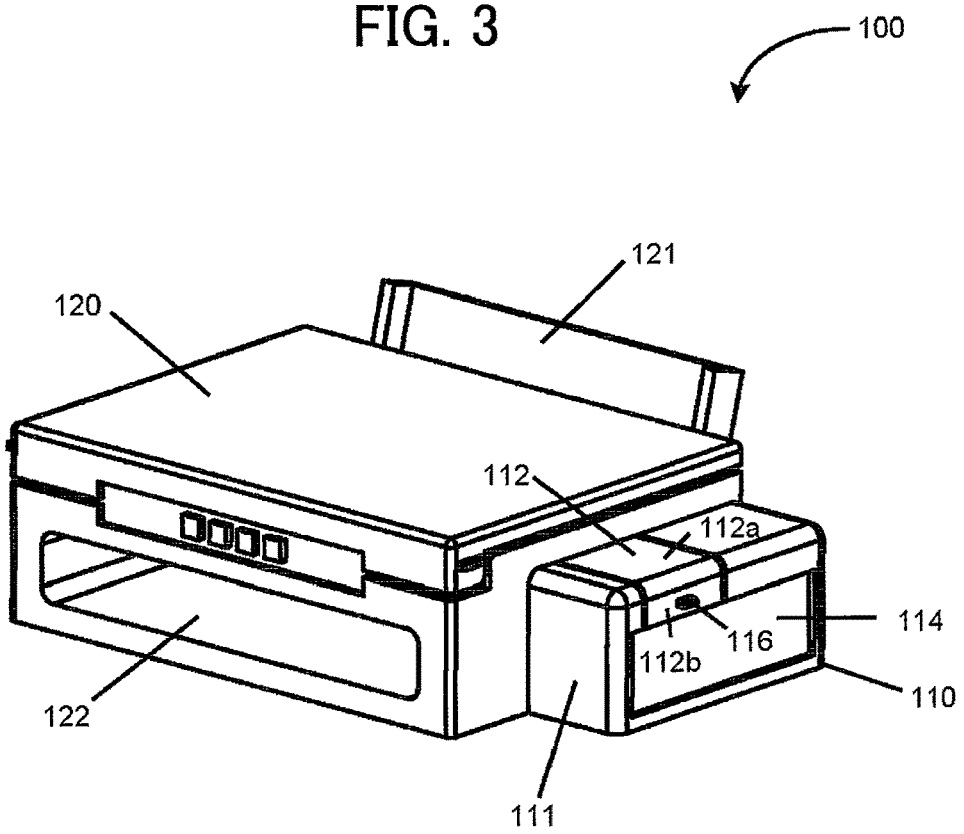
FIG. 3 is perspective view of an inkjet printer to which the ink-accommodation unit according to the preferred embodiment is attached, wherein the cover is in the closed position.
Figure 4:
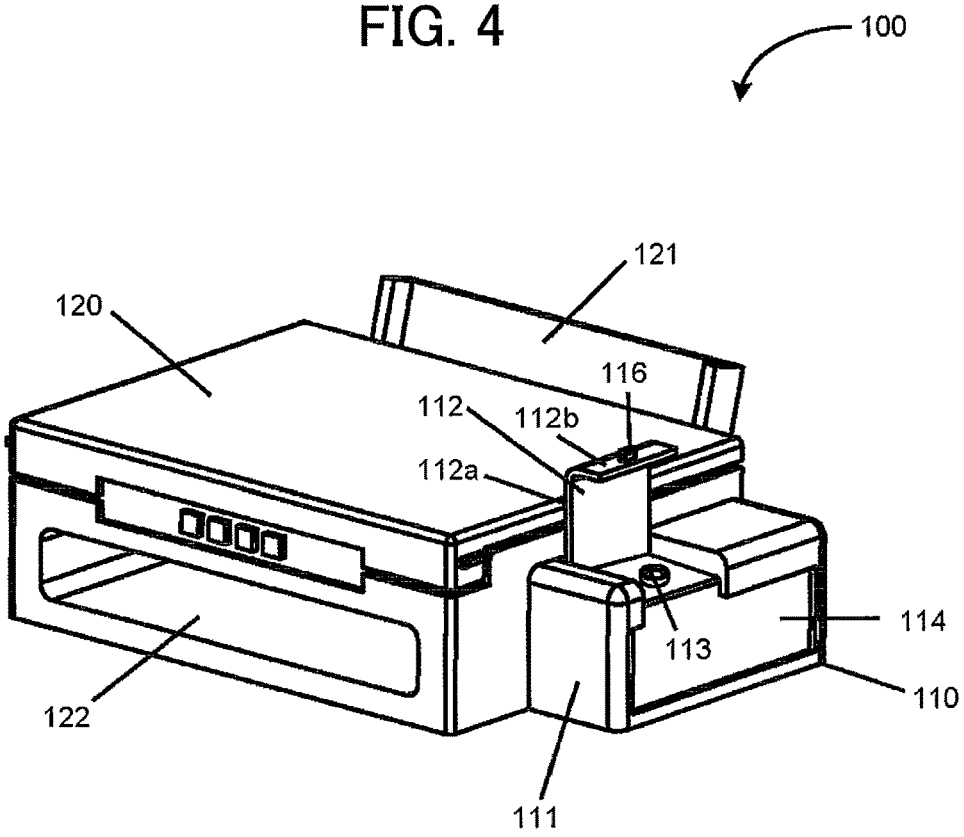
FIG. 4 is perspective view of the inkjet printer to which the ink-accommodation unit according to the preferred embodiment is attached, wherein the cover is in its open position.

As depicted in FIGS. 2 to 4, an inkjet printer 100 has a generally box-shaped outer shape. Preferably, the inkjet printer 100 may have a distance (width) of 435 mm in a left-right direction. The inkjet printer 100 includes a printer main body 120 and an ink-accommodation unit 110. The printer main body 120 includes a sheet-feeder portion 121 and a sheet-discharging portion 122. Preferably, the ink-accommodation unit 110 may have a distance (i.e., width) of 42 mm in a left-right direction. Preferably, a ratio of the width of the ink-accommodation unit 110 to the width of the printer main body may range from 1:11 to 1:9. Here, the sheet-feeder portion 121 is provided at a rear portion of the printer main body 120. The sheet-discharging portion 122 is provided at a front portion of the printer main body 120. The ink-accommodation unit 110 is provided at a right side surface of the printer main body 120 to extend rightward therefrom. While the ink-accommodation unit 110 is provided to the right of the printer main body 120 in the depicted embodiment, it should be well understood that the ink-accommodation unit 110 may be provided at another portion of the printer main body 120. The ink-accommodation unit 110 may be removably attached to the printer main body 120 through a well-known connecting method (for example, by using a screw connecting member). Not to mention, the ink-accommodation unit 110 may be integrally molded with the printer main body 120.

As an illustrative example, when a sheet is placed on the sheet-feeder portion 121, the sheet is fed from the sheet-feeder portion 121 into an inside of the inkjet printer where an image is recorded on a surface of the sheet. The sheet is discharged onto the sheet-discharging portion 122 thereafter.

Inside the printer main body 120, a carriage (not shown) configured to make reciprocating movement over the surface of the sheet may be provided. On one end of the carriage that faces the sheet, a recording head (not shown) in which a plurality of nozzles is formed is mounted. When performing printing (recording), ink within the ink-accommodation unit 110 is supplied to the recording head through a flexible ink supply tube (not shown), and is then ejected from the recording head toward the sheet.

Normally, the carriage is driven by a driving mechanism (not shown), and is guided by a guide rail (not shown) so as to be able to move reciprocatingly over the sheet. Other than that, generally, a sheet conveying device (not shown) used for conveying sheets is disposed within the printer main body 120. The sheets are sequentially conveyed in association with reciprocating movement of the carriage, while ink is ejected from the recording head. In this way, images are recorded on the sheets.

As depicted in FIGS. 2 to 4, the ink-accommodation unit 110 includes an ink-accommodating body 111 (as an example of a "first member") and a cover 112 (as an example of a "second member"). In the following description, the first member designates the ink-accommodating body and is a fixed member used to accommodate ink therein. The second member is a member used to cover at least a portion of the ink-accommodating body (i.e., the inlet and the like in the present invention) of the ink-accommodation unit 110.

In the present embodiment, the ink-accommodating body 111 has a generally rectangular parallelepiped shape. To facilitate explanation, in a state to be used, a direction in which a longer side of the ink-accommodating body 111 extends in a projection onto a horizontal plane will be referred to as the front-rear direction, while a shorter side of the ink-accommodating body 111 in a projection onto a horizontal plane will be referred to as the left-right direction.

In the present embodiment, the ink-accommodating body 111 includes separate members: an ink-tank holder and an ink tank (not shown). The ink tank is accommodated in the ink-tank holder and is configured to accommodate ink therein. The ink that the printer main body 120 uses for printing is supplied through the ink tank. An injection portion 113 is provided at an upper surface of the ink tank to protrude upward therefrom to facilitate user's injection of ink into the ink tank. The injection portion 113 has an opening (inlet) that is open upward. It should be noted that, other than the opening (inlet), the injection portion 113 may include a sealing member (not shown) configured to seal the opening to prevent evaporation or leakage of the ink.

Figure 5:
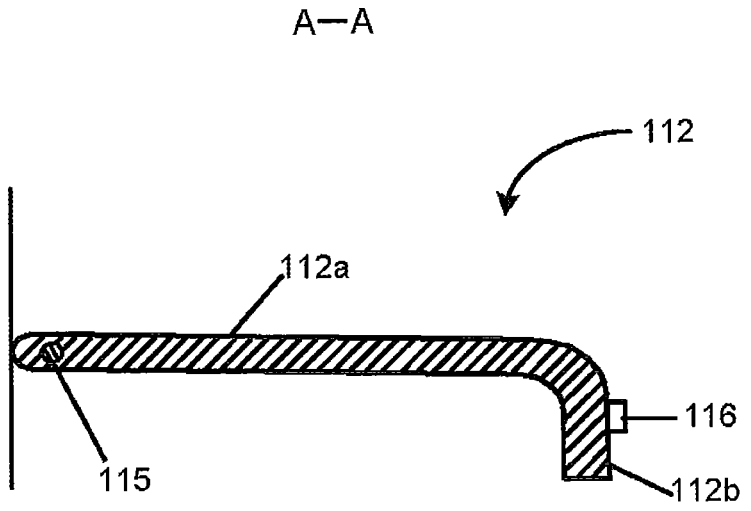
FIG. 5 is a partial cross-sectional view of the ink-accommodation unit of FIG. 2 taken along a line A-A therein.

FIG. 5 is a partially enlarged cross-sectional view of the cover 112 taken along a line A-A depicted in FIG. 2. As depicted, the cover 112 is a member having a generally "¬" shape in cross-section. The cover 112 includes a horizontal upper wall 112*a* (as an example of a "first portion") and a lower wall 112*b* vertically connected to the upper wall 112*a* (as an example of a "second portion"). Preferably, the upper wall 112*a* and the lower wall 112*b* are formed integrally. The cover 112 is pivotably movably connected to the ink-accommodating body 111. The cover 112 is pivotable between a closed position and an open position relative to the ink-accommodating body 111. FIG. 3 depicts a state where the cover 112 is in the closed position, whereas FIG. 4 depicts a state where the cover 112 is at the open position. As apparent from the drawings, when the cover 112 is at the closed position, the upper wall 112*a* is in a horizontal state and covers the ink-accommodating body 111 to cover the injection portion 113. When the cover 112 is at the open position, the upper wall 112*a* is in an upright state and the injection portion 113 is exposed. When ink needs to be injected, the upper wall 112*a* of the cover 112 is pivoted from the horizontal state to the upright state so that the injection portion 113 can be changed from its covered state to its exposed state to allow the user to immediately perform injection of ink.

As depicted in FIGS. 3 and 4, in the present embodiment, a pivot axis of the cover 112 is parallel to the front-rear direction with respect to the ink-accommodation unit 110, and is positioned at a side closer to the printer main body 120. Accordingly, as depicted in FIG. 4, when the cover 112 is at the open position, the cover 112 is retained at the side adjacent to the printer main body 120. This structure does not obstruct an ink-amount display screen 114 of the ink-accommodating body 111. Normally, on the ink-amount display screen 114 shown are an upper-limit display line and a lower-limit display line, or other amount display lines indicating amounts of ink in the ink tank. While filling ink into the ink tank, the user can confirm how much amount of ink has been injected by referring to the amount display lines on the ink-amount display screen 114. In the present embodiment, when injecting ink into the ink tank via the injection portion 113, the user can visually confirm, on the exposed ink-amount display screen 114, a liquid surface of the already injected ink clearly without any hindrance. This structure can prevent injection of too much ink that may cause contamination on the surrounding environment (such as the inkjet printer 100, a hand or cloth of the user, or white printing sheets or already-printed sheets). As a result, this structure can reduce a likelihood of contamination of the surrounding environment.

As is apparent from FIG. 4, when the cover 112 at the open position is viewed from above, the cover 112 at the open position does not occupy any extra space rearward of the inkjet printer. Hence, when the inkjet printer 100 is placed on the desk, there is no need to consider in advance about preserving a space for the cover 112 that is to be opened toward rearward of the inkjet printer 100. Further, the inkjet printer 100 may be placed such that a rear portion of the inkjet printer 100 is directly in contact with a wall. This structure can save a space on the desk for allowing something else to be placed on the desk. In particular, this structure is very advantageous in case that only a limited space is available on the desk. Furthermore, this structure is beneficial for user's use, since this structure eliminates the need to move the inkjet printer 100 to a spacious place to open the cover 112 for filling ink into the ink-accommodation unit 110.

FIGS. 2 to 5 depict an embodiment of how to pivotably movably connect the cover 112 relative to the ink-accommodating body 111. In particular, as depicted in FIGS. 4 and 5, a pivot shaft 115 is provided at a side of the cover 112, the side being closer to the printer main body 120. The pivot shaft 115 extends in the front-rear direction with respect to the ink-accommodation unit 110. A pair of pivot holes (not shown) is provided in the ink-accommodating body 111 at positions corresponding to the both ends of the pivot shaft 115. By pivoting the pivot shaft 115 within the pivot hole, the cover 112 is pivotably connected to the ink-accommodating body 111. Alternatively, a pivot hole may be provided at the cover 112, while a pivot shaft suitable for pivoting within the pivot hole may be provided at the ink-accommodating body 111. With this structure as well, the cover 112 may be pivotably movably connected to the ink-accommodating body 111. Not to mention, in order to realize pivotable connection between the cover 112 and the ink-accommodating body 111, other pivotably connecting structures well-known in the art may be employed. For example, a structure using a hinge of a door may be employed, or a connecting belt made of a flexible material may be provided to connect the cover 112 and the ink-accommodating body 111. It would be understood by a skilled person in the art that, no matter what connecting structure is employed, a certain gap should be provided between the pivot axis of the cover 112 and the printer main body 120. Due to the gap, the cover 112 can be retained at the open position after the cover 112 is opened.

In the present embodiment, a grip 116 is disposed at the cover 112. Preferably, the grip 116 is provided at a side of the cover 112, the side being farther away from the pivot axis of the cover 112. For example, as depicted in FIGS. 2 to 5, the grip 116 may be provided at the lower wall 112*b* of the cover 112. This structure can require a smaller force to open and close the cover 112 by means of the grip 116. In other embodiment not described herein, the grip 116 may be disposed at the side that is farther away from the pivot axis on the upper wall 112*a*. Not to mention, the grip 116 may be disposed at another portion of the cover 112: for example, at a center portion of the upper surface.

Figure 6:
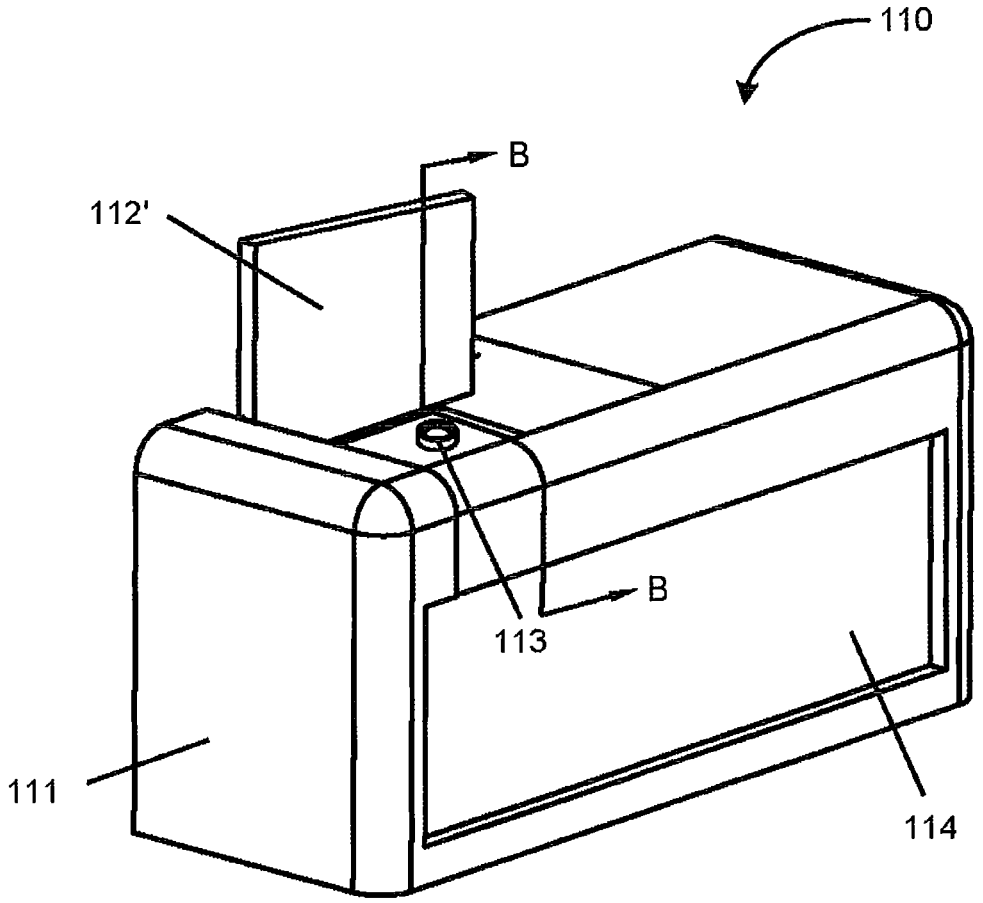
FIG. 6 is a perspective view of an ink-accommodation unit according to another preferred embodiment of the present invention, wherein a cover thereof is in its open position.
Figure 7:
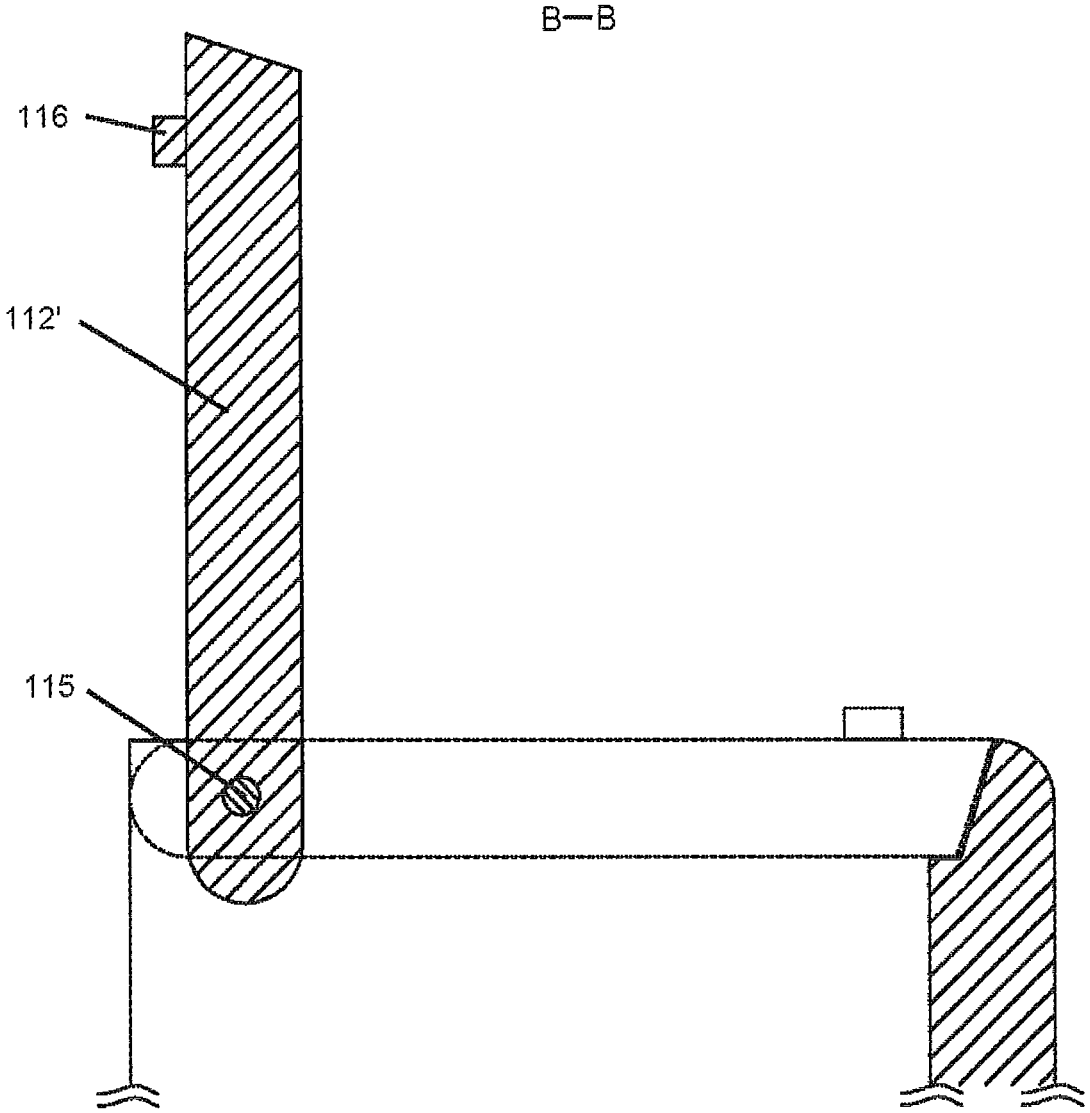
FIG. 7 is a partial cross-sectional view of the ink-accommodation unit of FIG. 6 taken along a line B-B therein.

FIGS. 6 and 7 depict another embodiment of a cover. FIG. 6 is a perspective view of ink-accommodation unit according to the other embodiment, and the cover thereof is at its open position. FIG. 7 is a partial cross-sectional view of the ink-accommodation unit of FIG. 6 taken along a line B-B shown therein. The embodiment of FIGS. 6 and 7 is different from the embodiment depicted in FIGS. 2 to 5 in that a cover 112' of FIGS. 6 and 6 has a flat plate like shape and only includes a horizontal upper surface. The grip 116 is provided at one end of the cover 112' that is farther away from the pivot axis thereof. A method to operate the cover 112' is identical to that of the cover 112 depicted in FIGS. 2 to 5, and will not be described here in detail to simplify explanation.

In the embodiments depicted in FIGS. 2 to 7, the cover 112, 112' has a size that is about one-half of a size of the ink-accommodating body 111 within a horizontal plane. However, it is apparent that the size and a shape of the cover 112, 112' may be changed. For example, the size of the cover 112, 112' within a horizontal plane may be generally the same as the size of the ink-accommodating body 111, or the cover 112, 112' may be occupy a further smaller portion of the ink-accommodating body 111 (about one-third thereof, for example). A skilled person in the art may appropriately select the size and the shape of the cover 112, 112' based on various elements, such as the number and a shape of the injection portion.

In the embodiments depicted in FIGS. 2 to 7, the ink-accommodating body 111 includes separate structures: the ink tank configured to accommodate ink therein; and the ink-tank holder (not shown) that accommodates the ink tank. Needless to say, the ink tank and the ink-tank holder may be fixedly attached so as to be detachable from each other, or may be designed so as not to be detachable from each other. Preferably, the ink-accommodating body may be integrally formed such that: a chamber for storing ink may be formed inside the ink-accommodating body; and the injection portion 113 may be formed at an upper surface of the ink-accommodating body so as to be in communication with the chamber.

Embodiment 2

Figure 8:
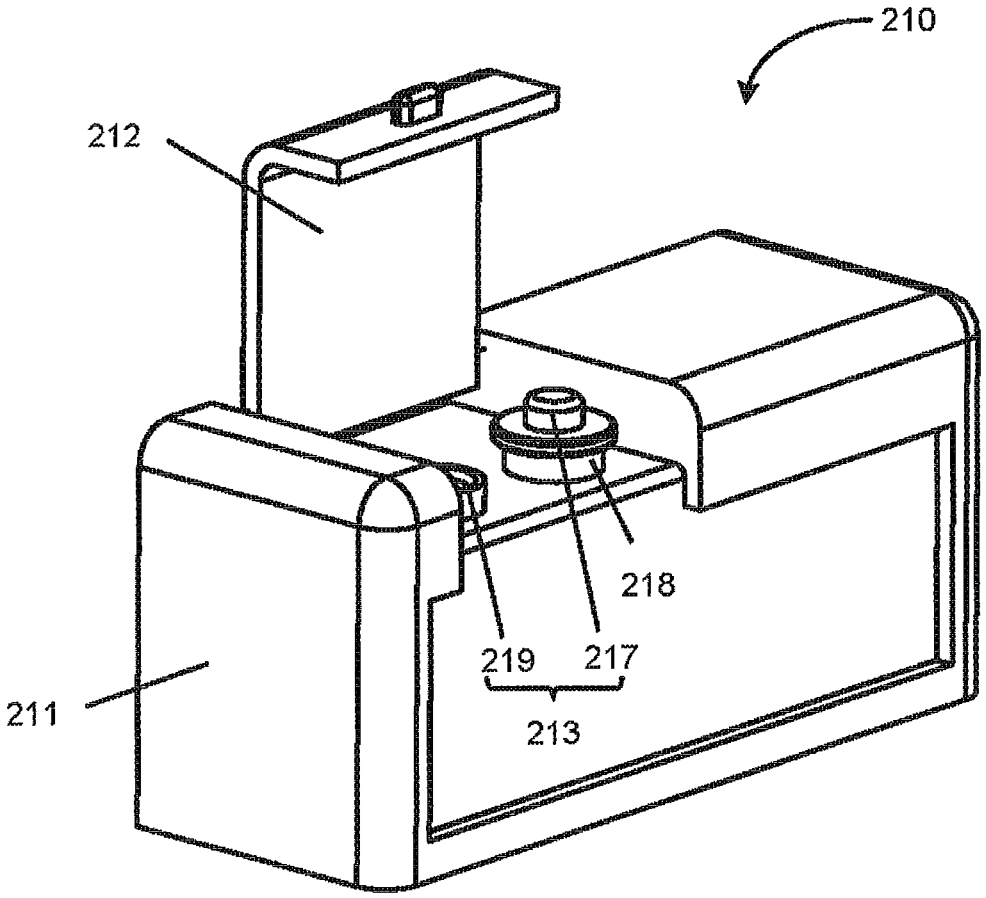
FIG. 8 is a perspective view of an ink-accommodation unit according to still another preferred embodiment of the present invention, wherein a cover thereof is in its open position.

An ink-accommodation unit according to the embodiment 2 is conceptually depicted in FIG. 8. For simplifying explanation, in the description of the embodiment 2, the same parts and components as those of the embodiment 1 will not be described.

As depicted in FIG. 8, the embodiment 2 is different from the embodiment 1 in that an injection portion 213 includes an inlet 219, and a sealing member 217 corresponding to the inlet 219. An ink-accommodating body 211 further includes a mount portion 218 corresponding to the inlet 219. The sealing member 217 is adapted to seal the inlet 219 and serves to prevent leakage and evaporation of ink in the ink tank. During use of the printer, when a cover 212 is at the closed position, the sealing member 217 is normally positioned on the inlet 219 to seal the inlet 219. The sealing member 217 and the inlet 219 together thus constitute the injection portion 213. The mount portion 218 is so designed to be suitable for placing the sealing member 217 on the mount portion 218 as well as to be able to hold the sealing member 217. Here, "hold" means restricting movement of the sealing member 217 in a horizontal direction. With this structure, every time the user places the sealing member 217 on the mount portion 218, the user can place the sealing member 217 generally at the same position, which in turn contributes to confining the ink adhered to the sealing member 217 to the mount portion 218. The injection portion 213 and inlet 219 are covered by the cover 212 when the cover 212 is at the closed position, whereas the injection portion 213 and inlet 219 are exposed when the cover 212 is at the open position. It should be noted here that, in the present embodiment, exposure of the injection portion 213 denotes a state where the injection portion 213 is visible, and does not necessarily mean that the inlet 219 is opened. In other words, when the injection portion 213 is exposed, the inlet 219 may be in an open state, or may be sealed by the sealing member 217.

Figure 1:
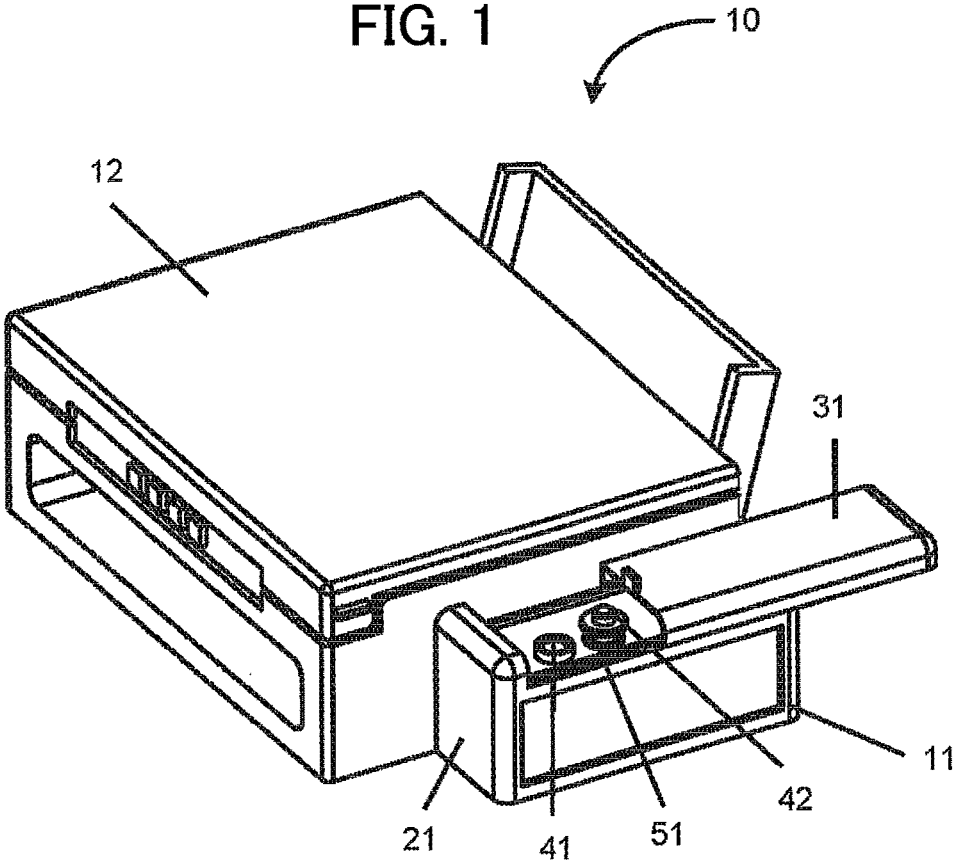
FIG. 1 is a perspective view conceptually illustrating an inkjet printer to which a conventional ink-accommodation unit is fixedly attached.

When using the conventional inkjet printer (depicted in FIG. 1), particularly in the process of filling ink into an ink chamber in the ink-accommodation unit, there may arise following circumstances: when the inlet 41 is fully exposed but a mount portion 51 is not yet exposed, the user may open a sealing member 42 on the inlet and place the sealing member 42 somewhere in order to perform an operation for injecting ink. In such circumstances, since ink is likely to be adhered to the sealing member 42, contamination may possibly result at and around the position where the sealing member 42 is placed. For example, the inkjet printer may be contaminated, user's hands or cloths may be contaminated, or furthermore white printing sheets and printed sheets may be contaminated. Other than that, placing the sealing member 42 somewhere else may cause adhesion of foreign matters to the sealing member 42. If this is the case, when the sealing member 42 covers the inlet 41, the sealing member 42 may contaminate the ink in an ink-accommodating body 11, which in turn may cause a clog in an ink supply tube or damage to the inkjet printer 10. Such circumstances tend to occur particularly when the user fills ink into the ink-accommodating body 11 for the first time.

In contrast, the method of the embodiment depicted in FIG. 8 can prevent occurrence of the above-described circumstances. FIG. 8 depicts a state where the cover 212 is at the open position and the injection portion 213 and the mount portion 218 are fully exposed. In the present embodiment, the injection portion 213 and the mount portion 218 become simultaneously visible to the user when the cover 212 is opened. Therefore, the user can place the sealing member 217 on the mount portion 218 after removing the sealing member 217 from the inlet 219. For the user, especially for the user who injects ink into an ink-accommodation unit 210 for the first time, the user is encouraged to perform injection of ink immediately after seeing the inlet 219, while being discouraged from placing the sealing member 217 somewhere else, thereby eliminating occurrence of contamination of the surrounding environment (for example, the inkjet printer, hands and cloths of the user, or while printing sheets or printed sheets). The probability of contamination in the surrounding environment can be reduced, and the ink adhered to the sealing member 217 can be restricted from moving from a region near the mount portion 218. At the same time, foreign matters from other places do not enter into the ink, and therefore clogging of the ink supply tube or damage to the inkjet printer would not occur. Accordingly, improved operability can be obtained for the user of the ink-accommodation unit 210 and the inkjet printer.

In the present embodiment, the inlet 219, the mount portion 218 and the sealing member 217 are generally circular shaped in a projection onto a horizontal plane. Further, there are provided one each of the inlet 219, the mount portion 218 and the sealing member 217. The sealing member 217 may be manufactured by an elastic material, and may include a sealing portion constituting a lower portion and a grip portion constituting an upper portion. The sealing portion may be used for sealing the inlet 219. The sealing portion includes a main portion having a generally cylindrical columnar shape, and has an upper portion provided with a protruding periphery extending outward. The grip portion is useful for the user to remove the sealing member 217 from the inlet 219 and to attach the sealing member 217 to the inlet 219. The sealing member 217 has a shape and a size in conformity with those of the inlet 219. The mount portion 218 is a recessed groove formed on an upper surface of the ink-tank holder. The recessed groove has an inner diameter that is slightly larger than an outer diameter of the lower portion of the sealing member 217.

For example, the inner diameter of the inlet 219 may be about 11.5 mm, while the outer diameter of the lower portion of the sealing member 217 may be about 12 mm which is slightly larger than the inner diameter of the inlet 219. This structure can provide a tight sealing of the inlet 219. The inner diameter of the mount portion 218 may be about 12.5 mm which is slightly larger than the outer diameter of the lower portion of the sealing member 217, in order for the sealing member 217 to be suitably placed. Other structures may be employed for the sealing member 217 and the mount portion 218. For example, structures using magnetic forces or engagement structures may be employed. Other than that, a distance between the sealing member 217 and mount portion 218 may not be fixed, provided that the ink adhered to the sealing member 217 can be confined to a region within the mount portion 218 when the sealing member 217 is placed on the mount portion 218.

FIG. 8 depicts merely examples of the inlet, the mount portion and the sealing member. It is apparent that other suitable shapes may be employed therefore. Alternatively, the inlet 219, mount portion 218 and sealing member 217 may be shaped like a polygon, an ellipse, or a combination of a circle, an ellipse and a polygon. Needless to say, the numbers of the inlet and the mount portion and an alignment direction of the inlet and the mount portion should not be limited. For example, the number of the inlet and the number of the mount portion may be plural. The inlet and the mount portion may be aligned in a direction slightly inclined relative to the front-rear direction of the ink-accommodating body. Here, the alignment direction of the inlet and the mount portion denotes a direction of a line connecting centers of the inlet and the mount portion.

Further, from a point of view of ergonomics, a distance between the inlet 219 and the mount portion 218 may be designed to be convenient for the user. For example, a linear distance between the centers of the inlet 219 and the mount portion 218 may be set to be 25 mm.

Further, a connecting member may be provided. One end of the connecting member may be connected to the sealing member 217, while another end of the connecting member may be connected to the ink-accommodating body 211. The connecting member may have an arbitrary length, provided that the sealing member 217 spans between the mount portion 218 and inlet 219.

At the time of use of the inkjet printer of the embodiment depicted in FIG. 8, a monochrome image may be printed using only a black-colored ink. In this case, within the ink-accommodating body 211, only one ink tank is provided, with provision of one inlet 219 and one sealing member 217. One mount portion 218 corresponding to the one sealing member 217 may be provided on the ink-accommodating body.

Based on actual demands, a plurality of ink tanks may be provided within the ink-accommodation unit 210 (a plurality of ink chambers may be formed in case that the ink-accommodating body 211 is an integral member). For example, four pieces of ink thanks may be provided for accommodating four kinds of colors of ink, cyan, magenta, yellow and black, respectively, to perform color printing. Alternatively, within the ink-accommodation unit, six, eight or twelve pieces of ink tanks may be provided to store six, eight or twelve different kinds of colors of ink, respectively, to perform color printing using these six, eight or twelve different colors of ink. In this case, the numbers of the inlets 219, the sealing members 217 and the mount portions 218 may be plural, or may correspond to four, six, eight or twelve, for example. The number of mount portions 218 may be the same as the number of the sealing members 217. A corresponding mount portion 218 is provided for each of the sealing members 217. This structure can prevent transferring of contamination from one color to another color.

In the embodiment depicted in FIG. 8, the ink-accommodation unit 210 includes only one cover 212. However, a skilled person in the art would understand that, when the ink-accommodation unit 210 includes a plurality of (two, for example) inlets (mount portions), the number of the covers may be changed: for example, two covers may be provided. Since each cover covers only a pair of the inlet and the mount portion, only one cover needs to be opened at the time of injection of ink, thereby reducing the probability of contamination by ink.

Here, referring to FIGS. 9 and 10, other embodiments including connecting members will be described in detail.

Figure 9:
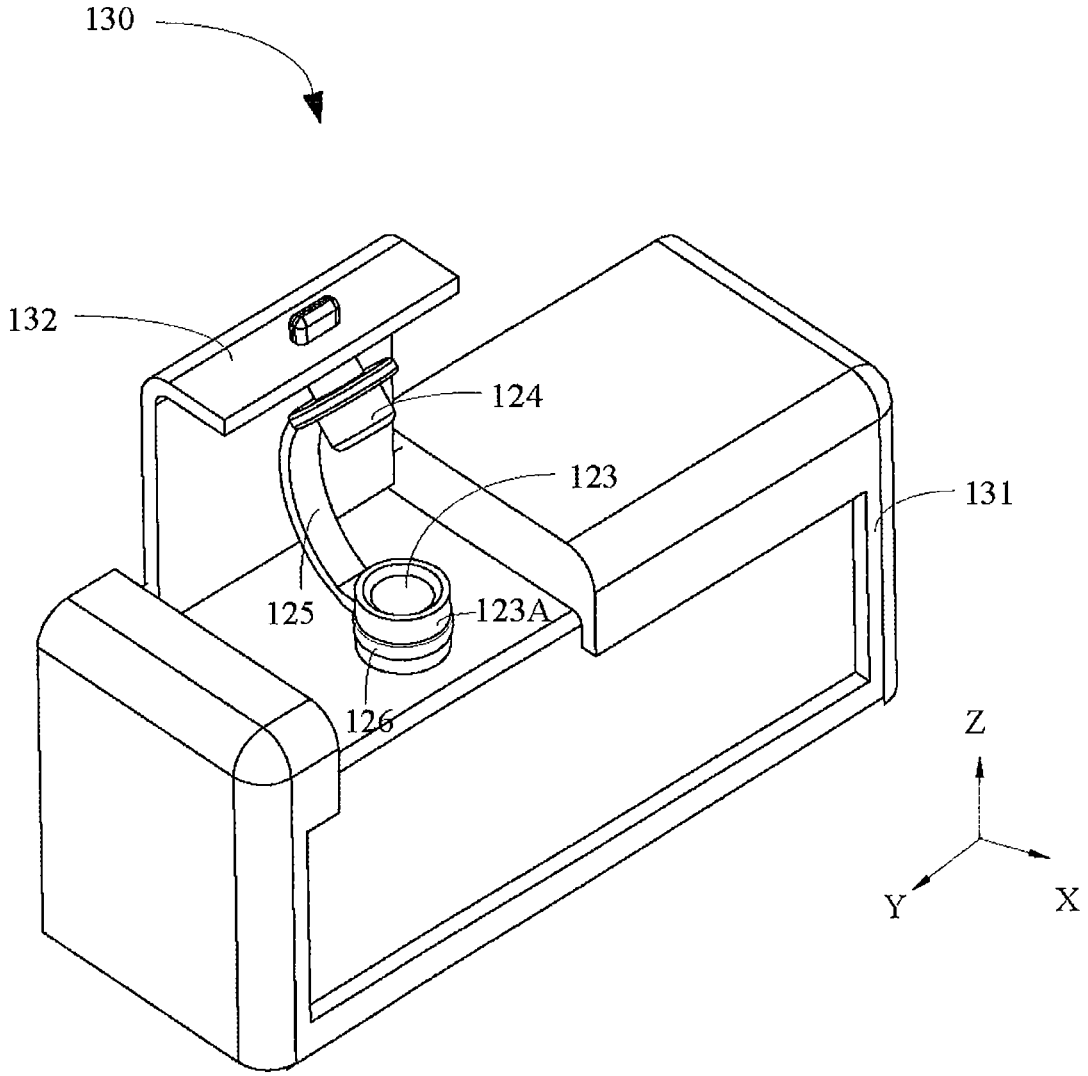
FIG. 9 is a perspective view of an ink-accommodation unit according to still another preferred embodiment of the present invention, wherein a sealing member thereof is separated from an inlet.

As another embodiment, FIG. 9 conceptually depicts an ink-accommodation unit 130 that may include a connecting member 125 of a flat belt-like shape. One end of the connecting member 125 is connected to a sealing member 124. Another end of the connecting member 125 is connected to a connecting-member fixing portion 126 belonging to an inlet 123 on an ink-accommodating body 131. With this structure, the sealing member 124 is connected to the ink-accommodating body 131.

Preferably, in the present embodiment, the inlet 123 has a generally cylindrical shape, and has a side wall 123A extending upward from an upper surface of the ink tank. The side wall 123A protrudes upward from one opening of a recessed portion of the ink-accommodating body 131. The connecting-member fixing portion 126 has a ring-like shape, and is firmly fixed to an outer surface of the side wall 123A of the inlet 123.

Figure 10:
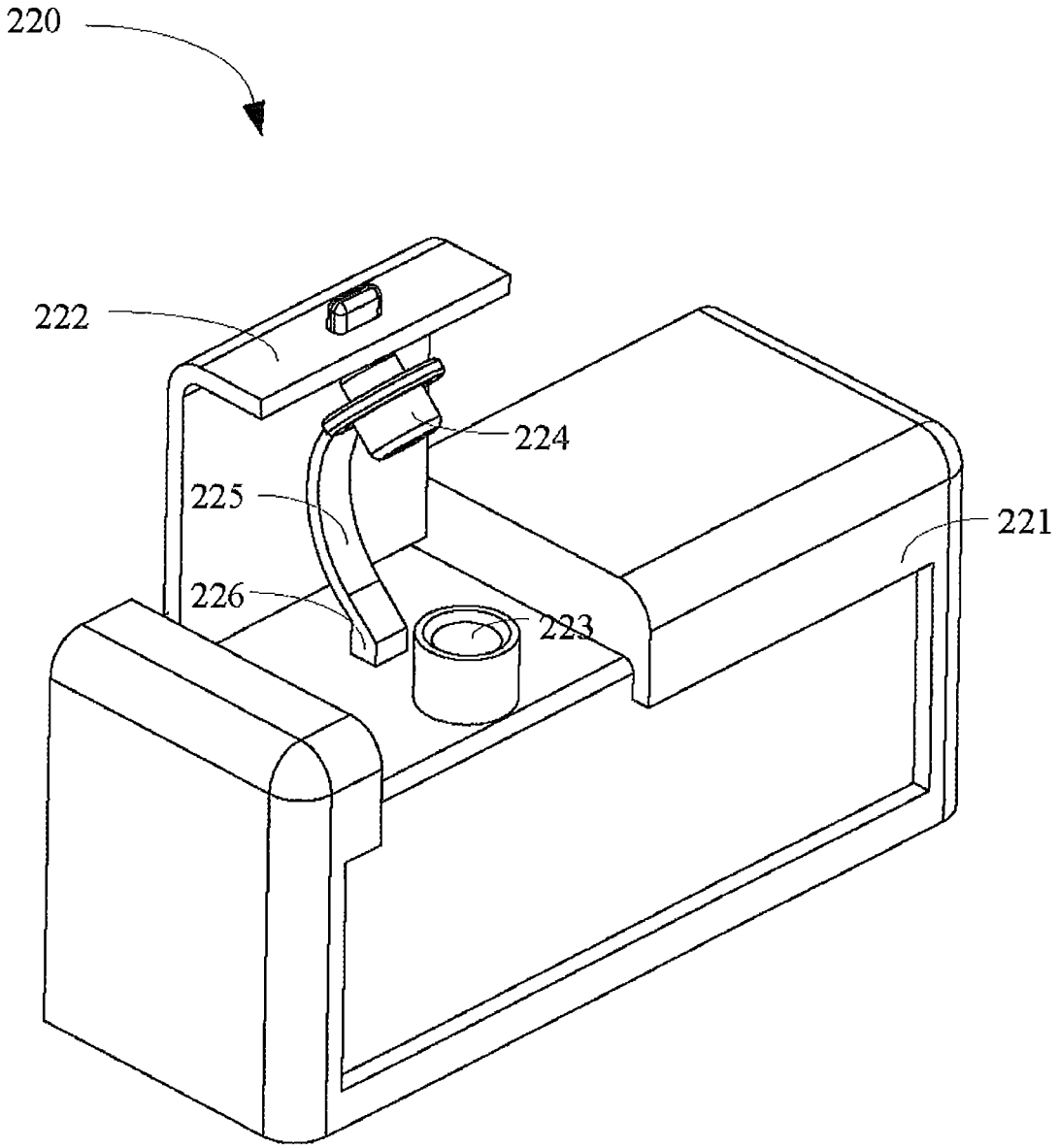
FIG. 10 is a perspective view of an ink-accommodation unit according to yet another preferred embodiment of the present invention, wherein a sealing member thereof is separated from an inlet.

As another embodiment, FIG. 10 conceptually depicts an ink-accommodation unit 220 that includes a connecting member 225. The connecting member 225 may have one end connected to a sealing member 224, and another end connected to a connecting-member fixing portion 226 on an ink-accommodating body 221.

Summarizing the present invention and the above-described embodiments, the ink-accommodation unit used in the inkjet printer described in the present invention facilitates the user's operability by reducing a space on the desk that the inkjet printer occupies when the inkjet printer to which the ink-accommodation unit is attached is placed on the desk on one hand, and on the other hand by eliminating the user's need to repeatedly carry the inkjet printer that would be required if a space rearward of the inkjet printer was insufficient to open the cover.

Further, according to an aspect, the injection portion includes an inlet and a sealing member corresponding to the inlet; the first member further includes a mount portion corresponding to the inlet; the sealing member is used for sealing the inlet and the mount portion is used for placing the sealing member; and the injection portion and the mount portion are covered by the second member when the second member is at the closed position and are exposed when the second member is at the open position. Since the injection portion and the mount portion are all exposed to the user when the second member is opened, the user can place the sealing member on the mount portion after removing the sealing member from the inlet. This structure can avoid occurrence of such circumstances that are likely to occur in the conventional art: that is, the user may perform injection of ink immediately upon seeing the inlet and put the sealing member on somewhere else, thereby causing contamination of the surrounding environment.

Further, according to an aspect, the second member includes a grip and the grip is provided at an outer surface of the second member. The user can utilize the grip to open and close the second member, thereby further enhancing operability.

Further, according to an aspect, the grip is provided at one end of the second member that is farther away from the axis. The user is required a smaller force to open the second member.

Further, according to an aspect, the second member includes a first portion and a second portion connected perpendicularly to the first portion; and the grip is provided at an outer surface of the first portion or at an outer surface of the second portion. The user's opening and closing of the second member can be facilitated, since the user can operate the grip.

Further, according to an aspect, the second member has a flat plate-like shape. A production process can be further simplified.

Further, according to an aspect, the ink-accommodation unit further includes a connecting member; the injection portion includes an inlet and a sealing member corresponding to the inlet, the connecting member having one end connected to the sealing member; and another end of the connecting member is used for fixing the connecting member to a connecting-member fixing portion that is provided at the first member. The length of the connecting member can be made relatively shorter, thereby facilitating user's operation.

Further, according to an aspect, the inlet includes a side wall; and the connecting-member fixing portion is provided on at an outer surface of the side wall of the inlet. The length of the connecting member can be made relatively shorter, thereby facilitating user's operation.

When the inkjet printer according to the present invention is placed on the desk, a space on the desk occupied by the inkjet printer can be reduced. Further, when the user tries to inject ink, the user is no longer required to carry the inkjet printer repeatedly due to lack of enough space rearward of the inkjet printer. User's operability can be thus enhanced.

The ordinal numbers, such as "first" and "second" cited in the present application merely signifies labels, and do not involve any other meaning that represents a particular order, for example. Further, for example, a technical term "first member" itself does not imply presence of a "second member". Likewise, the technical term "second member" itself does not imply presence of the "first member".

Unless otherwise defined, the terms used in the description and the technical terms that a skilled person in the art of the present invention normally understand have the same meanings. The technical terms used in the description are merely for describing the specific purposes of the embodiments, and should not be limited thereto. The terms such as "member" that appear in the present description may represent a single member, or may represent a combination of a plurality of members. The terms such as "attach" or "provide" that appear in the present description may denote direct attachment of one member to another member, or may denote attachment of a member to another member via an intermediate member. The feature described in one embodiment may be applied to other embodiments alone or in combination with other features, unless the feature is not applicable to other embodiments or unless different explanations are given for the feature.

While the present invention has been described through the embodiments, it should be understood that the above depicted embodiments are presented merely for explanatory purpose and do not intend to limit the present invention to the scope of the depicted embodiments. Other than that, it would be understood for a skilled person in the art that the present invention is not limited to the depicted embodiments, and various changes and modifications may be made therein based on teachings of the present invention. These changes and modifications fall within the scope that the present invention seeks to protect.

What is claimed is:

1. An ink-accommodation unit provided in an inkjet printer including a printer main body, the ink-accommodation unit comprising:

a first member configured to accommodate therein ink to be supplied to the printer main body, the first member including an injection portion through which the ink is configured to be injected;

a second member pivotably movably connected to the first member, the second member being pivotable about a pivot axis relative to the first member between a closed position and an open position, the injection portion being covered by the second member when the second member is at the closed position, the injection portion being exposed when the second member is at the open position; and a connecting member, wherein the pivot axis is parallel to a front-rear direction with respect to the first member and is positioned at a side of the first member, the side being closer to the printer main body, wherein the injection portion comprises an inlet and a sealing member corresponding to the inlet, the connecting member having one end connected to the sealing member, wherein the connecting member has another end adapted to fix the connecting member to a connecting-member fixing portion, wherein the connecting-member fixing portion is provided on an outer surface of the first member at a position between the pivot axis and the inlet of the injection portion, and wherein the connecting-member fixing portion and the inlet are overlapped with each other as viewed in a left-right direction with respect to the first member.

2. The ink-accommodation unit as recited in claim 1, wherein the second member comprises a grip, the grip being provided at an outer surface of the second member.

3. The ink-accommodation unit as recited in claim 2, wherein the grip is provided at a side of the second member, the side being farther away from the pivot axis.

4. The ink-accommodation unit as recited in claim 3, wherein the second member comprises a first portion and a second portion connected perpendicularly to the first portion, the grip being provided at an outer surface of the first portion or at an outer surface of the second portion.

5. The ink-accommodation unit as recited in claim 3, wherein the second member has a flat plate-like shape.

6. An inkjet printer comprising:

a printer main body; and an ink-accommodation unit, the ink-accommodation unit comprising:

a first member configured to accommodate therein ink to be supplied to the printer main body, the first member including an injection portion through which the ink is configured to be injected;

a second member pivotably movably connected to the first member, the second member being pivotable about a pivot axis relative to the first member between a closed position and an open position, the injection portion being covered by the second member when the second member is at the closed position, the injection portion being exposed when the second member is at the open position; and a connecting member, wherein the pivot axis is parallel to a front-rear direction with respect to the first member and is positioned at a side of the first member, the side being closer to the printer main body, wherein the injection portion comprises an inlet and a sealing member corresponding to the inlet, the connecting member having one end connected to the sealing member, wherein the connecting member has another end adapted to fix the connecting member to a connecting-member fixing portion, the connecting-member fixing portion being provided at the first member, wherein the connecting-member fixing portion is provided on an outer surface of the first member at a position between the pivot axis and the inlet of the injection portion, and wherein the connecting-member fixing portion and the inlet are overlapped with each other as viewed in a left-right direction with respect to the first member.

7. The ink-accommodation unit as recited in claim 6, wherein the connecting member is configured to retain the sealing member above the inlet when the second member is at the open position.

8. The inkjet printer as recited in claim 6, wherein the connecting member is configured to retain the sealing member above the inlet when the second member is at the open position.

* * * * *